US005193984A

United States Patent [19]

Lin

[11] Patent Number: 5,193,984

[45] Date of Patent: Mar. 16, 1993

[54] FAN ASSEMBLY

[75] Inventor: Kun-Yuan Lin, Taichung, Taiwan

[73] Assignee: Deng-Huei Huang, Taiwan

[21] Appl. No.: 774,336

[22] Filed: Oct. 10, 1991

[51] Int. Cl.[5] ..... B64C 11/00

[52] U.S. Cl. ..... 416/247 R; 415/208.1; 415/211.2; 362/96

[58] Field of Search ..... 415/204, 206, 208.1, 415/211.2; 416/247 R, 63; 362/96

[56] References Cited

U.S. PATENT DOCUMENTS

| | | | |
|---|---|---|---|
| 1,889,567 | 11/1932 | Persons | 415/211.2 |
| 2,201,153 | 5/1940 | Brown | 415/211.2 |
| 2,582,532 | 1/1952 | Dean | 415/211.2 |
| 2,618,435 | 11/1952 | Koch | 415/211.2 |
| 2,625,319 | 1/1953 | Reisch | 415/211.2 |
| 2,640,646 | 6/1953 | Jones | 415/211.2 |
| 2,642,220 | 6/1953 | Koch | 415/211.2 |
| 2,652,193 | 9/1953 | Lindberg et al. | 415/211.2 |
| 3,010,645 | 11/1961 | Mandelstam | 416/63 |

*Primary Examiner*—John T. Kwon
*Attorney, Agent, or Firm*—Bacon & Thomas

[57] ABSTRACT

Disclosed herein is a fan which has a conical guide in an upper protection cover of the fan for guiding air flow to disperse in 360 degrees, a lamp hood on the guide, a lighting element and a set of batteries in the guide, and a push-button switch in the center of the upper protection cover to turn on and off the lighting element. Moreover, the lamp hood is formed with a plurality of slots so that a plurality of openings are formed after assembly of the guide and the lamp hood, and an appropriate quantity of cotton or other liquid-absorptive material is placed in the guide so that perfume can be poured through the openings and then absorbed by the cotton or other liquid-absorptive material to provide an aromatic smell during operation of the fan.

8 Claims, 3 Drawing Sheets

FAN ASSEMBLY

BACKGROUND OF THE INVENTION (a) Field of the Invention

The present invention related to a structure of fan assembly, particularly a fan assembly which permits dispersion of air flow in 360 degrees, and incorporates a lamp. The fan assembly includes mainly a conical guide in an upper protection cover of the fan to guide the direction of airflow, a lighting element, a set of batteries in the guide, and a push button switch in the center of the upper protection cover to turn on and off the lighting element. In addition, an appropriate quantity of cotton is placed to provide aromatic smell during operation of the fan after the cotton is moistened with perfume.

(b) Description of the Prior Art

Conventionally small fans are used particularly for providing of small said flow. Normally, they do not have any swivel mechanism so that air flows in a fixed direction. Moreover, due to the lack of additional uses, such small fans are of low added value, and their applications are limited. They cannot satisfy the need of consumers today who prefers to use products with diversified functions.

SUMMARY OF THE INVENTION

The main object of the present invention is to provide a small fan which permits dispersion of said flow in 360 degrees by means of a conical guide in the center of an upper protection cover for a fan.

Another object of the present invention is to provide a fan incorporated with a light by using a transparent lamp hood fixed on the conical guide. The lamp can be removed from the fan to become an independent light fixture.

Another object of the present invention is to provide a fan which can provide aromatic smell by placing an appropriate quantity of cotton in the guide so that an aromatic smell is dispersed during operation of the fan after the cotton is moistened with perfume.

DETAILED DESCRIPTION OF PREFERRED EMBODIMENT

Figure 1:
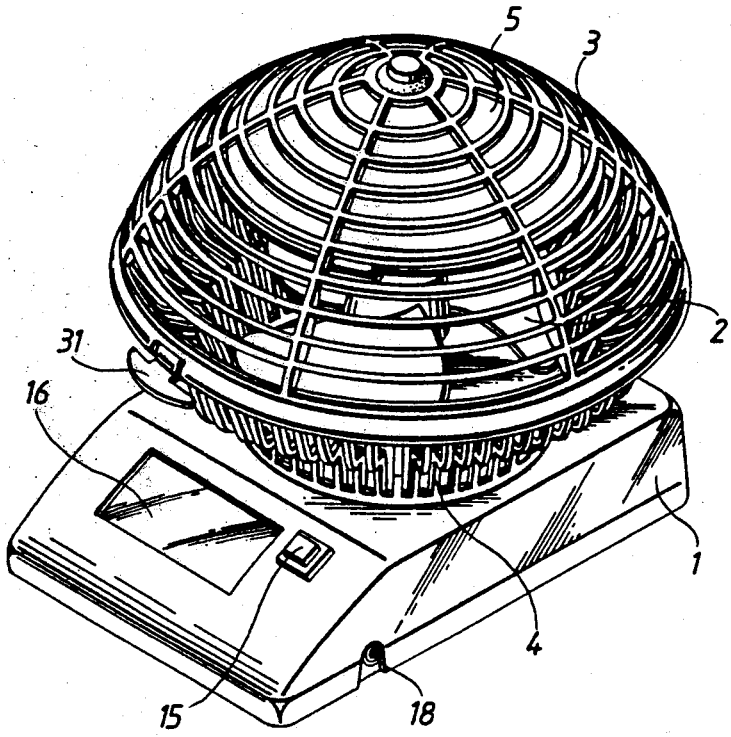
FIG. 1 is a perspective view of a fan according to the present invention.
Figure 2:
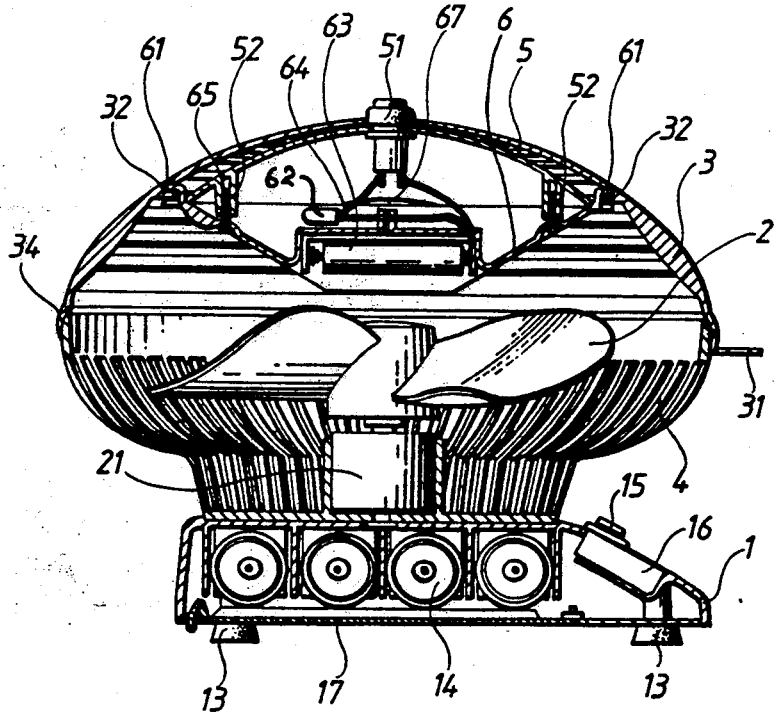
FIG. 2 is a sectional view of the fan according to the present invention.
Figure 3:
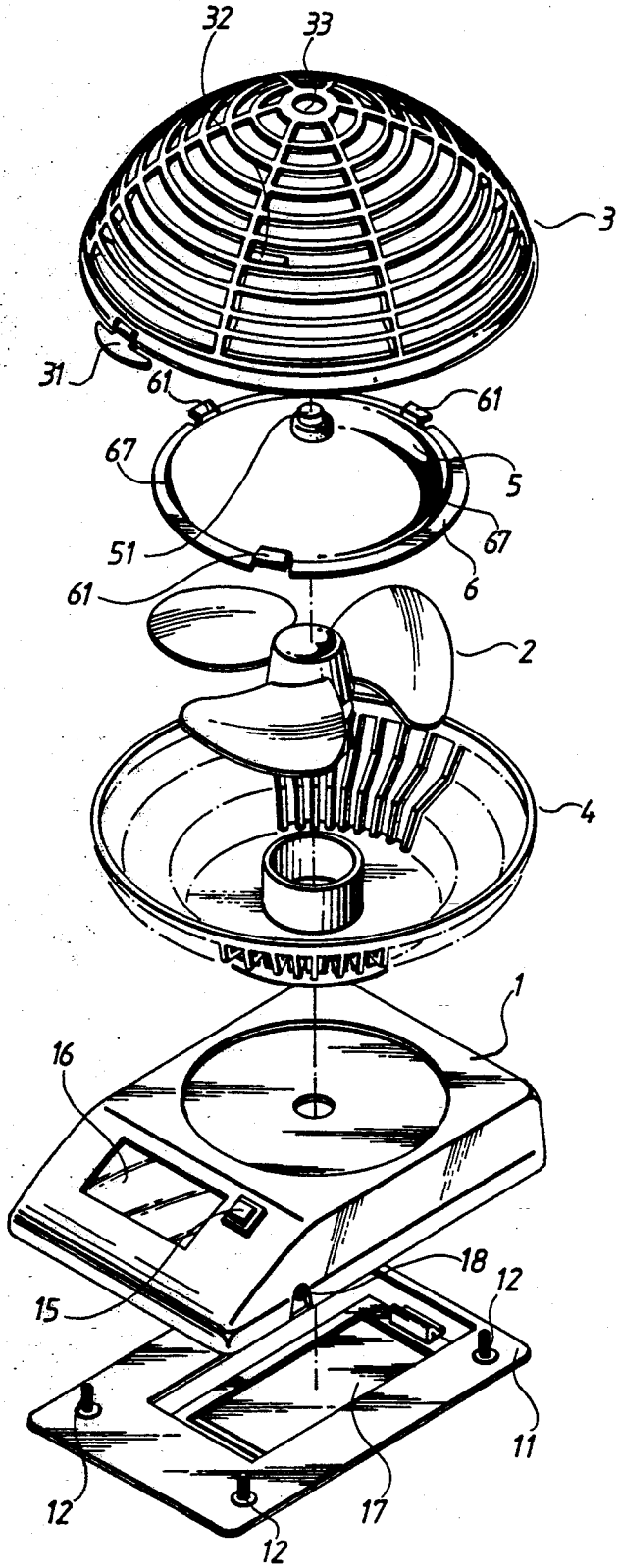
FIG. 3 is a perspective fragmental view of the fan according to the present invention.

As shown in FIGS. 1 to 3, the fan assembly of the present invention comprises mainly a base (1), a fan unit (2), an upper protection cover (3), a lower protection cover (4), a lamp hood (5), and a guide (6).

The base (1) has a bottom plate (11) which is fixed to the base (1) by means of bolts (12). A footing pad (13) is fitted to the end of each bolt (12). Within the base (1) a plurality of batteries (14) are placed. A fan control switch (15) and a LCD clock (16) are placed on the base (1) the in an accessible position. A movable battery chamber cover (17) is designed on the bottom plate (11) to ease loading and unloading of the batteries (14). A d.c. socket (18) is located at a side of the base (1) that a.c. current via an a.c. to d.c. transformer (not shown) can be used as power source.

The fan (2) is driven by a motor (21) as is known in the prior art, with therefore no description thereof will be given here.

The upper protection cover (3) is in the form of a circular grill composed of a plurality of circular ribs of different diameters, and has a locking element (31) at its circumference. A plurality of fixing elements (32) are designed at the inner edge of a selected rib at appropriate intervals so as to project toward the interior of upper protection cover (3). The upper protection cover (3) has a hole (33) at the center thereof and a connecting element (34) at a side opposite to the locking element (31) for fitting to the lower protection cover (4).

The lower protection cover (4) is formed with a plurality of ribs to form a guard, and has a motor fitting hole (41) at the center thereof.

The lamp hood (5) is in the form of a disk having a push-button switch (51) mounted in its center.

The guide (6) is in the form of a conical structure with a plurality of pinch hooks (61) spaced about the periphery thereof. The guide (6) has a battery chamber for batteries (63) at another end. The batteries (63) are connected to the push-button switch (51) with two conducting wires (64). The guide (6) is designed so as the lamp hood (5) is fixed thereof by means of bolts (66) extending through respective screw holes at the surface of the guide (6) and corresponding screw holes on the lamp hood (5).

For assembly of the present invention, the guide (6) is fixed to the upper protection cover (5) by engaging the pinch hooks (61) with the fixing elements (32). The guide (6) is held in place by the outward extending tendency exerted due to the elasticity of its material, such as plastic material. Air flow from the fan can be dispersed for 360 degrees by the guiding effect of the conical surface of the guide (6). Therefore, there is a special 360 degree air blowing effect. Since the push-button switch (51) is located at the center (33) of the upper protection cover (3), a light can be provided at the top of the fan when the push-button switch (51) is pushed to turn on a lighting element (62). Furthermore, the lamp hood (5) and the guide (6) can be removed from the assembly to become an independent lighting fixture.

Figure 4:
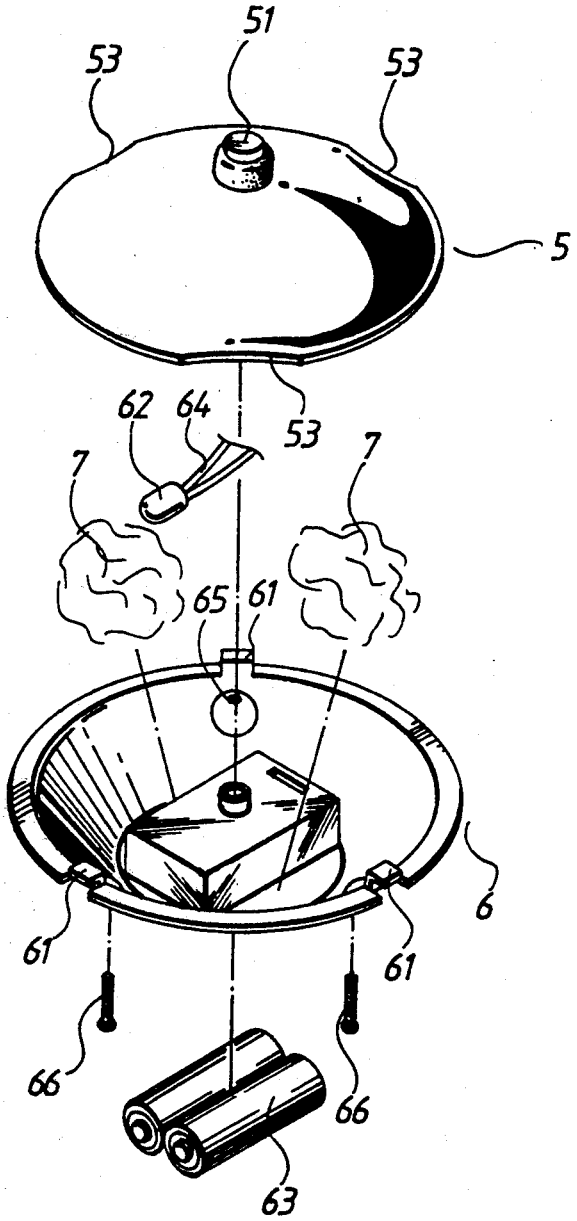
FIG. 4 is a perspective fragmental view of a lamp hood and a guide plate according to the present invention.

A suitable quantity of cotton or other liquid-absorptive material can be placed within the guide, and the lamp hood (5) can be designed with a plurality of slots (53) to form a plurality of openings (67) after assembly of the guide (6) and the lamp hood (5) as shown in FIG. 4. Then, perfume can be poured through the openings (67) and absorbed by the cotton so that an aromatic smell can be dispersed to the environments by operation of the fan (2).

I claim:

1. A fan assembly comprising:

a base;

a lower protective cover carried by said base;

a fan;

a motor drivingly connected to said fan, said motor being carried by said lower protective cover;

an upper protective cover removably secured to said lower protective cover, said upper protective cover comprising a grill composed on a a plurality of circular ribs of varying diameters, one of said ribs being formed with a plurality of inwardly projecting and annularly spaced fixing elements;

a conical-shaped guide member having a circumferential edge provided with a plurality of spaced hooking elements, each of said hooking elements being adapted to engage a respective one of said fixing elements for removably securing said guide member to said upper protective cover, said guide member being adapted to disperse air flow from said fan through said upper protective cover about 360 degrees thereof;

a lighting element carried by said guide member; and means for selectively supplying power to said fan and said lighting element.

2. The fan assembly of claim , further comprising a disk-shaped lamp hood extending above said lighting element.

3. The fan assembly of claim 2, wherein said lamp hood is attached to said guide member.

4. The fan assembly of claim 3, wherein said lamp hood is attached to said guide member by a plurality of bolts.

5. The fan assembly of claim 3, wherein said means for selectively supplying power to said lighting element comprises a push-button switch mounted in aligned central through holes formed in said upper protective cover and said lamp hood respectively and at least one battery, carried by said fan assembly, electrically connected to said lighting element through said switch.

6. The fan assembly of claim 5, wherein said guide member includes a battery chamber which houses said at least one battery.

7. The fan assembly of claim 3, wherein said lamp hood includes a plurality of spaced slots that define openings after said lamp hood is attached to said guide member and said fan assembly further includes a liquid-absorptive material adapted to be placed between said guide member and said lighting element such that an aromatic liquid can be poured into said openings and can be absorbed by said material so as to provide an aromatic scent during operation of said fan.

8. The fan assembly of claim 1, further comprising means for releasably locking said upper protective over to said lower protective cover.

* * * * *